US011566478B2

(12) United States Patent
Vu

(10) Patent No.: US 11,566,478 B2
(45) Date of Patent: Jan. 31, 2023

(54) COMPENSATED DRILL FLOOR

(71) Applicant: Ensco International Incorporated, Wilimgton, DE (US)

(72) Inventor: Van Van Vu, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 17/006,258

(22) Filed: Aug. 28, 2020

(65) Prior Publication Data

US 2021/0062592 A1 Mar. 4, 2021

Related U.S. Application Data

(60) Provisional application No. 62/893,741, filed on Aug. 29, 2019.

(51) Int. Cl.

| | |
|---|---|
| ***E21B 19/15*** | (2006.01) |
| ***E21B 19/00*** | (2006.01) |
| ***E21B 19/16*** | (2006.01) |

(52) U.S. Cl.

CPC ..... *E21B 19/155* (2013.01); *E21B 19/002* (2013.01); *E21B 19/006* (2013.01); *E21B 19/008* (2013.01); *E21B 19/165* (2013.01)

(58) Field of Classification Search

CPC .... E21B 19/002; E21B 19/006; E21B 19/008; E21B 19/155; E21B 19/165

See application file for complete search history.

(56) References Cited

U.S. PATENT DOCUMENTS

| | | | | |
|---|---|---|---|---|
| 4,616,708 | A | 10/1986 | da Mota | |
| 6,343,893 | B1 * | 2/2002 | Gleditsch | E21B 19/002 114/264 |
| 6,470,969 | B1 * | 10/2002 | Sorhaug | E21B 19/006 166/355 |
| 6,499,418 | B1 * | 12/2002 | Pollack | B63B 35/4413 114/265 |
| 6,691,784 | B1 * | 2/2004 | Wanvik | E21B 19/002 166/346 |
| 6,926,260 | B1 * | 8/2005 | De Groot | B66D 3/043 254/277 |
| 9,140,079 | B2 * | 9/2015 | Pohner | E21B 19/09 |
| 2001/0025727 | A1 | 10/2001 | Byrt et al. | |
| 2005/0129464 | A1 * | 6/2005 | Moncus | E21B 19/006 405/203 |
| 2017/0015391 | A1 * | 1/2017 | Vu | B63B 1/048 |

FOREIGN PATENT DOCUMENTS

| | | | | |
|---|---|---|---|---|
| GB | 2175946 A | * 12/1986 | | E21B 19/006 |
| WO | WO-0188323 A1 | * 11/2001 | | E21B 19/006 |

OTHER PUBLICATIONS

PCT Application No. PCT/US200/048598 International Search Report and Written Opinion, dated Dec. 10, 2020, 11 pgs.

* cited by examiner

*Primary Examiner* — James G Sayre
(74) *Attorney, Agent, or Firm* — Fletcher Yoder, P.C.

(57) ABSTRACT

A system includes a first structure configured to be coupled to a tubular string extending to a seafloor, whereby the first structure comprises a drill floor. The system further includes a second structure configured to provide a lateral force to the first structure while allowing for vertical movement between the first structure and the second structure relative to the seafloor.

20 Claims, 8 Drawing Sheets

COMPENSATED DRILL FLOOR

CROSS REFERENCE TO RELATED APPLICATIONS

This application is a Non-Provisional Application claiming priority to U.S. Provisional Patent Application No. 62/893,741, entitled "Offshore Platform", filed Aug. 29, 2019, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. Likewise, drilling advances have allowed for increased access to land based reservoirs.

However, offshore drilling and production facilities (e.g., offshore platforms) may encounter problems not typically found with land based drilling and production facilities. For example, when operating in water, lateral positioning techniques and systems (e.g., thrusters or similar devices) may be utilized to counteract lateral movement caused by currents, waves, and the like. Additionally, stability of the offshore platforms is to be maintained. One technique for maintaining the stability of an offshore platform is to design the platform to have a sufficient waterplane area (e.g., an enclosed area of the facility hull at the waterline) to allow for stability of the offshore platform. However, while increasing the waterplane area of an offshore platform may increase its stability (e.g., its ability to resist sway (lateral/side-to-side motion) and surge (longitudinal/front-and-back motion) imparted by maritime conditions), increasing the waterplane area of the offshore platform may also increase its susceptibility to heave (e.g., vertical/up-and-down motion). Solutions to address heave in the offshore platform and/or affecting components thereon are desirable.

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for stabilizing an drill floor of an offshore platform, such as a semi-submersible platform, a drillship, a spar platform, a floating production system, or the like, are set forth below. The offshore platform may include a drill floor that is suspended above a deck of the offshore platform. The drill floor can be restrained from horizontal movements with respect to the deck of the offshore platform and the drill floor can move vertically towards and away from the deck of the offshore platform in a controlled manner to resists heave (e.g., vertical/up-and-down motion) relative to a seafloor. In some embodiments, an actuation system that can, for example, include one or more drawworks, may be utilized to affect control of the vertical movement of the drill floor with respect to the deck of the offshore platform.

Figure 1:
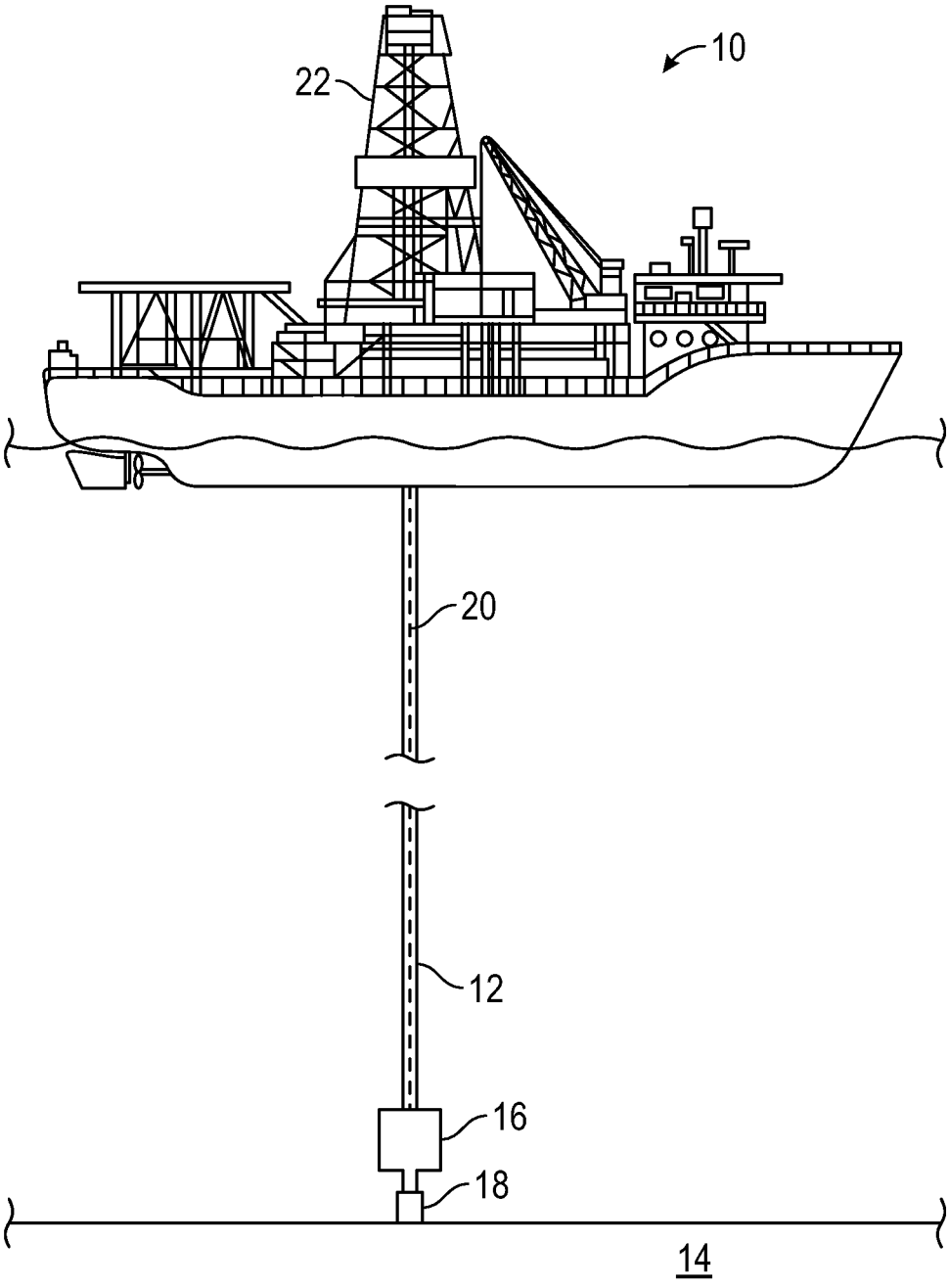
FIG. 1 (PRIOR ART)
FIG. 1 illustrates an example of an offshore platform having a riser coupled to a blowout preventer (BOP), in accordance with an embodiment.

With the foregoing in mind, FIG. 1 illustrates an offshore platform 10 as a drillship. Although the presently illustrated embodiment of an offshore platform 10 is a drillship (e.g., a ship equipped with a drilling system and engaged in offshore oil and gas exploration and/or well maintenance or completion work including, but not limited to, casing and tubing installation, subsea tree installations, and well capping), other offshore platforms 10 such as a semi-submersible platform, a jack up drilling platform, a spar platform, a floating production system, or the like may be substituted for the drillship. Indeed, while the techniques and systems described below are described in conjunction with a drillship, the techniques and systems are intended to cover at least the additional offshore platforms 10 described above. These techniques may also apply to at least vertical drilling or production operations (e.g., having a rig in a primarily vertical orientation drill or produce from a substantially vertical well) and/or directional drilling or production operations (e.g., having a rig in a primarily vertical orientation drill or produce from a substantially non-vertical or slanted well or having the rig oriented at an angle from a vertical alignment to drill or produce from a substantially non-vertical or slanted well).

As illustrated in FIG. 1, the offshore platform 10 includes a riser string 12 extending therefrom. The riser string 12 may include a pipe or a series of pipes that connect the offshore platform 10 to the seafloor 14 via, for example, a BOP 16 that is coupled to a wellhead 18 on the seafloor 14. In some embodiments, the riser string 12 may transport produced hydrocarbons and/or production materials between the offshore platform 10 and the wellhead 18, while the BOP 16 may include at least one BOP stack having at least one valve with a sealing element to control wellbore fluid flows. In some embodiments, the riser string 12 may pass through an opening (e.g., a moonpool) in the offshore platform 10 and may be coupled to drilling equipment of the offshore platform 10. As illustrated in FIG. 1, it may be desirable to have the riser string 12 positioned in a vertical orientation between the wellhead 18 and the offshore platform 10 to allow a drill string made up of drill pipes 20 to pass from the offshore platform 10 through the BOP 16 and the wellhead 18 and into a wellbore below the wellhead 18. Also illustrated in FIG. 1 is a drilling rig 22 (e.g., a drilling package or the like) that may be utilized in the drilling and/or servicing of a wellbore below the wellhead 18.

Figure 2:
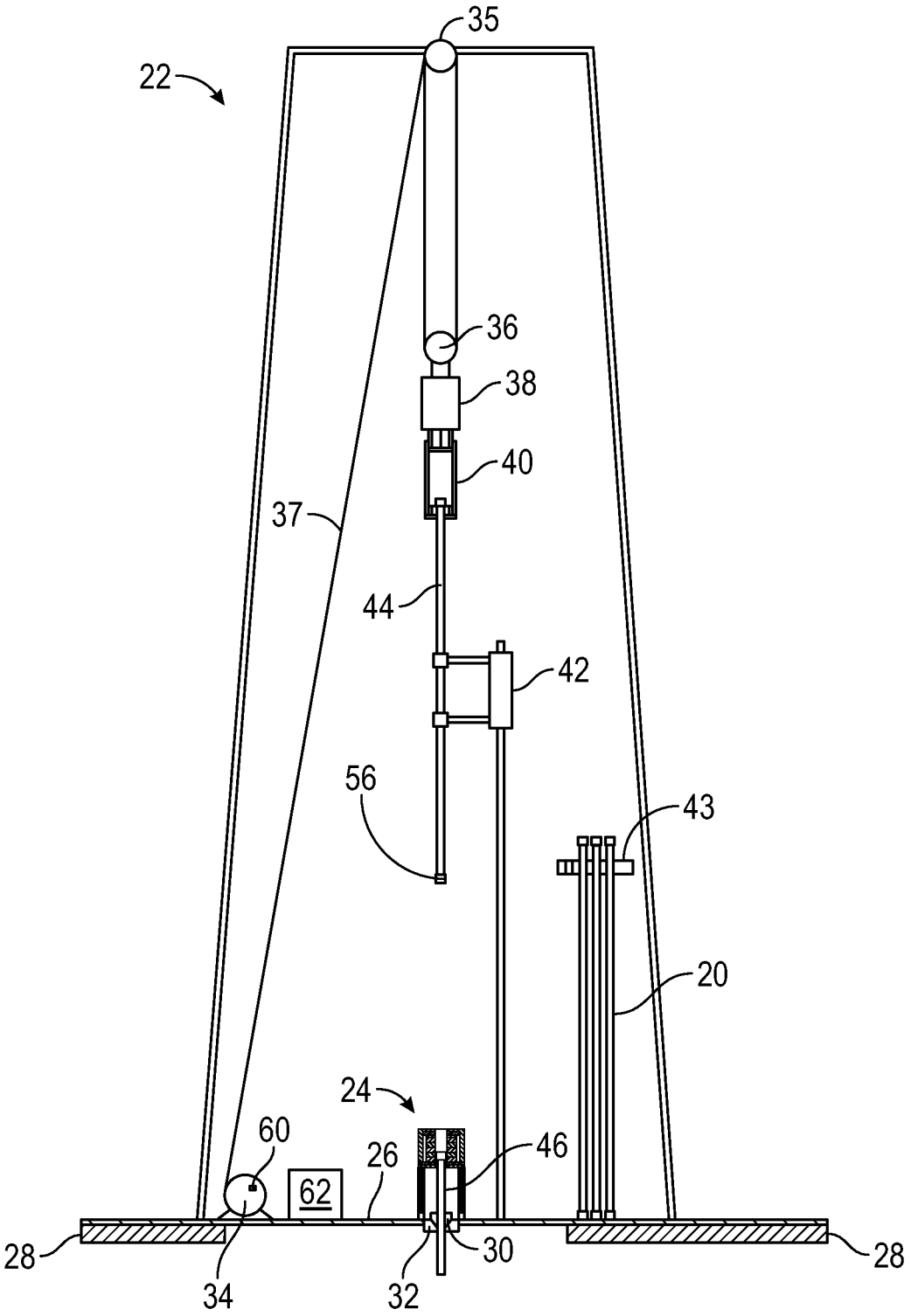
FIG. 2 illustrates a front view a first embodiment of a drilling rig as illustratively presented in FIG. 1, in accordance with an embodiment.

FIG. 2 illustrates in greater detail components of the drilling rig 22 as well as additional components used in various operations, such as a tripping operation. As illustrated, a tripping apparatus 24 is positioned on the drilling floor 26 in the drilling rig 22 above a deck 28. The drilling rig 22 may include one or more of, for example, the tripping apparatus 24, floor slips 30 positioned in rotary table 32, drawworks 34, a crown block 35, a travelling block 36, a top drive 38, an elevator 40, and a tubular handling apparatus 42. The tripping apparatus 24 may operate to couple and decouple tubular segments (e.g., drill pipe 20 to and from a drill string) while the floor slips 30 may operate to close upon and hold a drill pipe 20 and/or the drill string passing into the wellbore. The rotary table 32 may be a rotatable portion of the drilling floor 26 that may operate to impart rotation to the drill string either as a primary or a backup rotation system (e.g., a backup to the top drive 38).

The drawworks 34 may be a large spool that is powered to retract and extend line 37 (e.g., wire cable or drill line) over a crown block 35 (e.g., a vertically stationary set of one or more pulleys or sheaves through which the line 37 is threaded) and a travelling block 36 (e.g., a vertically movable set of one or more pulleys or sheaves through which the line 37 is threaded) to operate as a block and tackle system for movement of the top drive 38, the elevator 40, and any tubular member (e.g., drill pipe 20) coupled thereto. The top drive 38 may be a device that provides torque to (e.g., rotates) the drill string as an alternative to the rotary table 32 and the elevator 40 may be a mechanism that may be closed around a drill pipe 20 or other tubular members (or similar components) to grip and hold the drill pipe 20 or other tubular members while those members are moving vertically (e.g., while being lowered into or raised from the wellbore). The tubular handling apparatus 42 may operate to retrieve a tubular member from a storage location 43 (e.g., a pipe stand) and position the tubular member during tripping-in to assist in adding a tubular member to a tubular string. Likewise, the tubular handling apparatus 42 may operate to retrieve a tubular member from a tubular string and transfer the tubular member to a storage location 43 (e.g., a pipe stand) during tripping-out to remove the tubular member from the tubular string.

Figure 3:
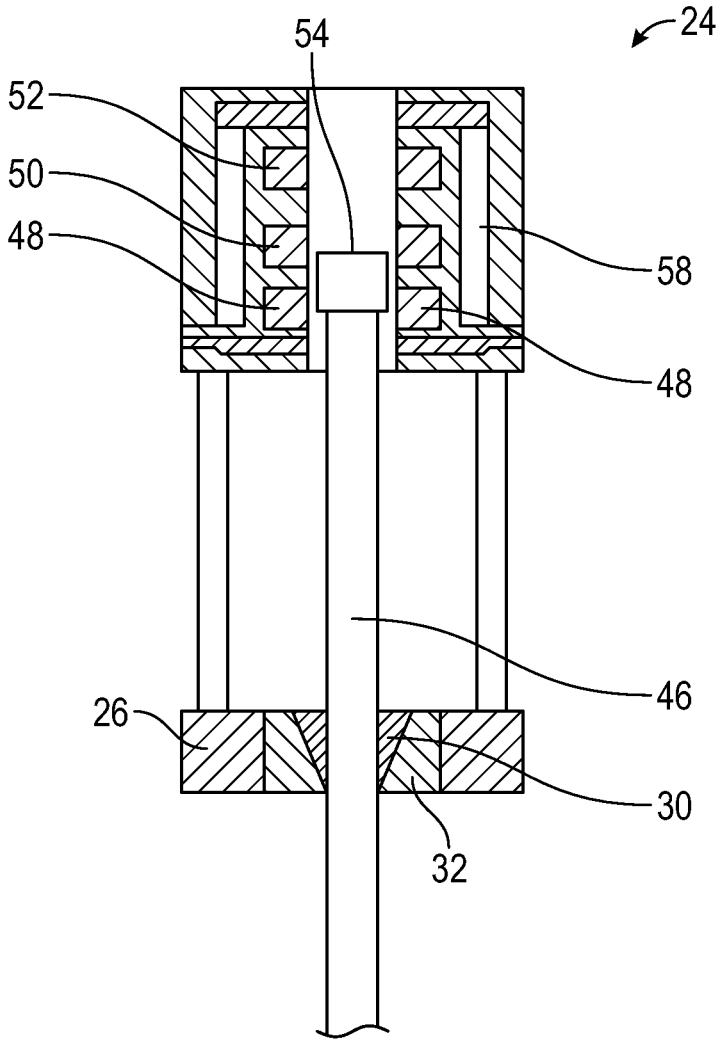
FIG. 3 illustrates a front view of the tripping apparatus of FIG. 2, in accordance with an embodiment.

For example, during a tripping-in operation, the tubular handling apparatus 42 may position a first tubular segment 44 (e.g., a first drill pipe 20) so that the tubular segment 44 may be grasped by the elevator 40. The elevator 40 may be lowered, for example, via the block and tackle system towards the tripping apparatus 24 to be coupled to a second tubular segment 46 (e.g., a second drill pipe 20) as part of a drill string. As illustrated in FIG. 3, the tripping apparatus 24 may be or may include a roughneck that may operate to selectively make-up and break-out a threaded connection between tubular segments 44 and 46 in a tubular string. In some embodiments, the tripping apparatus 24 may include one or more of fixed jaws 48, makeup/breakout jaws 50, and a spinner 52. In some embodiments, the fixed jaws 48 may be positioned to engage and hold the second (lower) tubular segment 46 below a threaded joint 54 thereof. In this manner, when the first (upper) tubular segment 44 is positioned coaxially with the second tubular segment 46 in the tripping apparatus 24, the second tubular segment 46 may be held in a stationary position to allow for the connection of the first tubular segment 44 and the second tubular segment (e.g., through connection of the threaded joint 54 of the second tubular segment 46 and a threaded joint 56 of the first tubular segment 44, illustrated in FIG. 2).

To facilitate this connection, the spinner 52 and the makeup/breakout jaws 50 illustrated in FIG. 3 may provide rotational torque. For example, in making up the connection, the spinner 52 may engage the first tubular segment 44 and provide a relatively high-speed, low-torque rotation to the first tubular segment 44 to connect the first tubular segment 44 to the second tubular segment 46. Likewise, the makeup/breakout jaws 50 may engage the first tubular segment 44 and may provide a relatively low-speed, high-torque rotation to the first tubular segment 44 to provide, for example, a rigid connection between the tubular segment 44 and 46. Furthermore, in breaking-out the connection, the makeup/breakout jaws 50 may engage the first tubular segment 44 and impart a relatively low-speed, high-torque rotation on the first tubular segment 44 to break the rigid connection. Thereafter, the spinner 52 may provide a relatively high-speed, low-torque rotation to the first tubular segment 44 to disconnect the first tubular segment 44 from the second segment 46.

In some embodiments, the tripping apparatus 24 may further include a mud bucket 58 that may operate to capture drilling fluid, which might otherwise be released during, for example, the break-out operation. In this manner, the mud bucket 58 may operate to prevent drilling fluid from spilling onto drill floor 26. In some embodiments, the mud bucket 58 may include one or more seals that aid in fluidly sealing the mud bucket 58 as well as a drain line that operates to allow drilling fluid contained within mud bucket 58 to return to a drilling fluid reservoir.

Returning to FIG. 2, one or more sensors 60 may be provided in conjunction with the drilling rig 22. In some embodiments, the one or more sensors 60 may be utilized in conjunction with a make-up (e.g., a tripping-in) and a break-out (e.g., a tripping-out) operation. In one embodiment, the one or more sensors 60 may include, but are not limited to, cameras (e.g., high frame rate cameras), lasers (e.g., multi-dimensional lasers), transducers (e.g., ultrasound transducers), electrical and or magnetic characteristic sensors (e.g., sensors that can measure/infer capacitance, inductance, magnetism, or the like), chemical sensors, metallurgical detection sensors, or the like. In some embodiments, the one or more sensors 60 may also be proximity sensors or other sensors (e.g., a rotational sensor such as an optical encoder, magnetic speed sensor, a reflective sensor, a hall effect sensor, a load cell such as an inline load cell) to detect operational characteristics of the drawworks 34 (e.g., rotation of a drum, speed of a drum, tension on line 37, or the like) that may include or be coupled to a transmitter. In some embodiments, the one or more sensors 60 may generate a signal indicative of operational characteristics of the drawworks 34 and may transmit, themselves or via a transmitter coupled thereto, a signal (wirelessly or via a physical connection) indicative of operational characteristic of the drawworks 34 to the computer system 62. This signal may be used to determine the location of an object (e.g., a drill pipe 20, the top drive 38, the elevator 40, the threaded joint 54 of a drill pipe 20, or the threaded joint 56 of a drill pipe 20) by the computer system 62, as the location of an object may be directly related to the operation of the drawworks 34 (e.g., the tension of the line 37 or an amount of rotation of a drum causing line 37 to be extended from the drawworks 34, which defines the location of the object suspended from the block and tackle system). The determined location of an object may be useful, for example, to determine and/or control where and when to move the tripping apparatus 24 into position (e.g., tool joint recognition) to perform a tripping operation. Likewise, the computer system 62 can monitor a tension value of the line 37 and cause the tension to be maintained at a particular value or within a range of values to aid maintain a desired tension of the line 37.

In some embodiments, the computing system 62 may be communicatively coupled to a separate main control system, for example, a control system in a driller's cabin that may provide a centralized control system for drilling controls, automated pipe handling controls, and the like. In other embodiments, the computing system 62 may be a portion of the main control system (e.g., the control system present in the driller's cabin).

Figure 4:
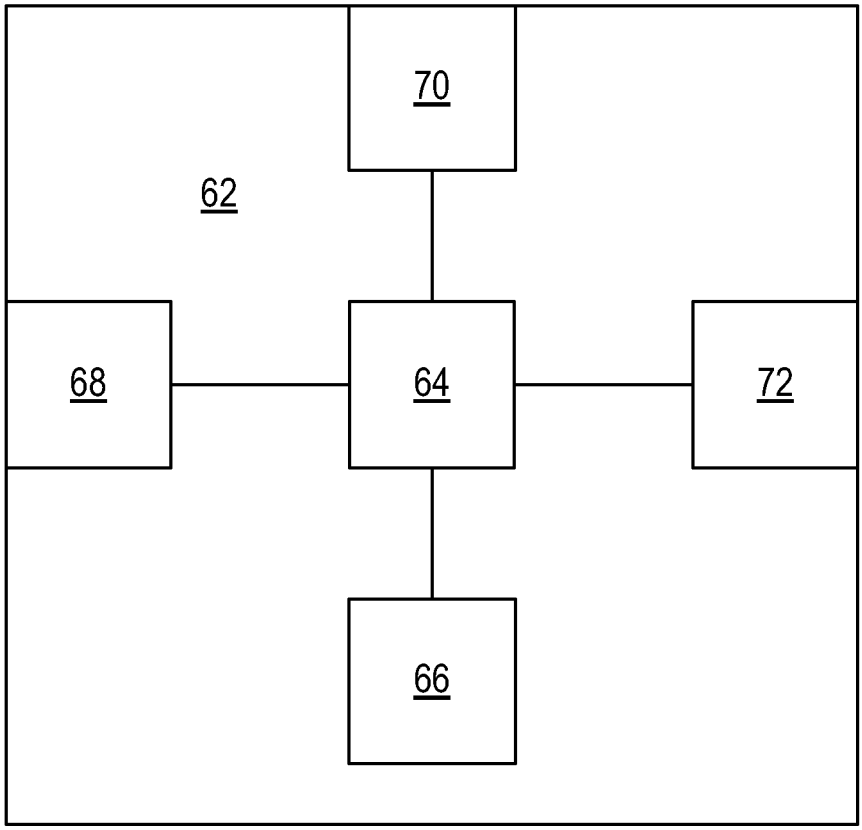
FIG. 4 illustrates a front view a second embodiment of a drilling rig as illustratively presented in FIG. 1, in accordance with an embodiment.

FIG. 4 illustrates the computing system 62. It should be noted that the computing system 62 may be a standalone unit (e.g., a control monitor) that may operate to generate output control signals (e.g., to form a control system). Likewise, the computing system 62 may be configured to operate in conjunction with the tripping apparatus 24, one or more of the drawworks 34, the top drive 38, and the elevator 40, and/or the tubular handling apparatus 42. The computing system 62 may be a general purpose or a special purpose computer that includes a processing device 64, such as one or more application specific integrated circuits (ASICs), one or more processors, or another processing device that interacts with one or more tangible, non-transitory, machine-readable media (e.g., memory 66) of the computing system 62, which may operate to collectively store instructions executable by the processing device 64 to perform the methods and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processing device 64. In some embodiment, the instructions executable by the processing device 64 are used to generate, for example, control signals to be transmitted to, for example, one or more of the tripping apparatus 24 (e.g., one or more of the fixed jaws 48, the makeup/breakout jaws 50, and the spinner 52), the tubular handling apparatus 42, one or more of the drawworks 34, the top drive 38, and the elevator 40 or a controller thereof, and/or a main control system (e.g., to be utilized in the control of the tripping apparatus 24, the fixed jaws 48, the makeup/breakout jaws 50, the spinner 52, the drawworks 34, the top drive 38, the elevator 40, and/or the tubular handling apparatus 42) to operate in a manner described herein.

The computing system 62 may operate in conjunction with software systems implemented as computer executable instructions stored in a non-transitory machine readable medium of computing system 62, such as memory 66, a hard disk drive, or other short term and/or long term storage. Particularly, the processing device 64 may operate in conjunction with software systems implemented as computer executable instructions (e.g., code) stored in a non-transitory machine readable medium of computing system 62, such as memory 66, that may be executed to receive information (e.g., signals or data) related to sensitivities of surge and/or swab pressures characteristics as well as well pressure characteristics. This information can be used by the computing system 62 (e.g., by the processing device 64 executing computer executable instructions stored in memory 66) to generate or otherwise calculate a tripping schedule that may be utilized to limiting tripping operation speeds to predetermined levels at predetermined times and/or well depths. Additionally, this determined tripping schedule can be used to initiate or control movement and/or operation of the tripping apparatus 24 and/or the associated tripping elements (e.g., the drawworks 34, the top drive 38, the elevator 40, and/or the tubular handling apparatus 42) to facilitate a make-up or break-out (e.g., tripping) operation by the computing system 62, the main control system, or by local controller(s) of the tripping apparatus 24 and/or the associated tripping elements (e.g., the drawworks 34, the top drive 38, the elevator 40, and/or the tubular handling apparatus 42).

In some embodiments, the computing system 62 may also include one or more input structures 68 (e.g., one or more of a keypad, mouse, touchpad, touchscreen, one or more switches, buttons, or the like) to allow a user to interact with the computing system 62, for example, to start, control, or operate a graphical user interface (GUI) or applications running on the computing system 62 and/or to start, control, or operate the tripping apparatus 24 (e.g., one or more of the fixed jaws 48, the makeup/breakout jaws 50, and the spinner 52), the tubular handling apparatus 42, and/or additional systems of the drilling rig 22. Additionally, the computing system 62 may include a display 70 that may be a liquid crystal display (LCD) or another type of display that allows users to view images generated by the computing system 62. The display 70 may include a touch screen, which may allow users to interact with the GUI of the computing system 62. Likewise, the computing system 62 may additionally and/or alternatively transmit images to a display of a main control system, which itself may also include a processing device 64, a non-transitory machine readable medium, such as memory 66, one or more input structures 68, a display 70, and/or a network interface 72.

Returning to the computing system 62, as may be appreciated, the GUI may be a type of user interface that allows a user to interact with the computer system 62 and/or the computer system 62 and one or more sensors that transmit data to the computing system through, for example, graphical icons, visual indicators, and the like. Additionally, the computer system 62 may include network interface 72 to allow the computer system 62 to interface with various other devices (e.g., electronic devices). The network interface 72 may include one or more of a Bluetooth interface, a local area network (LAN) or wireless local area network (WLAN) interface, an Ethernet or Ethernet based interface (e.g., a Modbus TCP, EtherCAT, and/or ProfiNET interface), a field bus communication interface (e.g., Profibus), a/or other industrial protocol interfaces that may be coupled to a wireless network, a wired network, or a combination thereof that may use, for example, a multi-drop and/or a star topology with each network spur being multi-dropped to a reduced number of nodes.

In some embodiments, one or more of the tripping apparatus 24 (and/or a controller or control system associated therewith), the tubular handling apparatus 42 (and/or a controller or control system associated therewith), associated tripping elements (e.g., the drawworks 34, the top drive 38, the elevator 40, and/or the tubular handling apparatus 42), and/or a main control system may each be a device that can be coupled to the network interface 72. In some embodiments, the network formed via the interconnection of one or more of the aforementioned devices should operate to provide sufficient bandwidth as well as low enough latency to exchange all required data within time periods consistent with any dynamic response requirements of all control sequences and closed-loop control functions of the network and/or associated devices therein. It may also be advantageous for the network to allow for sequence response times and closed-loop performances to be ascertained, the network components should allow for use in oilfield/drillship environments (e.g., should allow for rugged physical and electrical characteristics consistent with their respective environment of operation inclusive of but not limited to withstanding electrostatic discharge (ESD) events and other threats as well as meeting any electromagnetic compatibility (EMC) requirements for the respective environment in which the network components are disposed). The network utilized may also provide adequate data protection and/or data redundancy to ensure operation of the network is not compromised, for example, by data corruption (e.g., through the use of error detection and correction or error control techniques to obviate or reduce errors in transmitted network signals and/or data).

Figure 5:
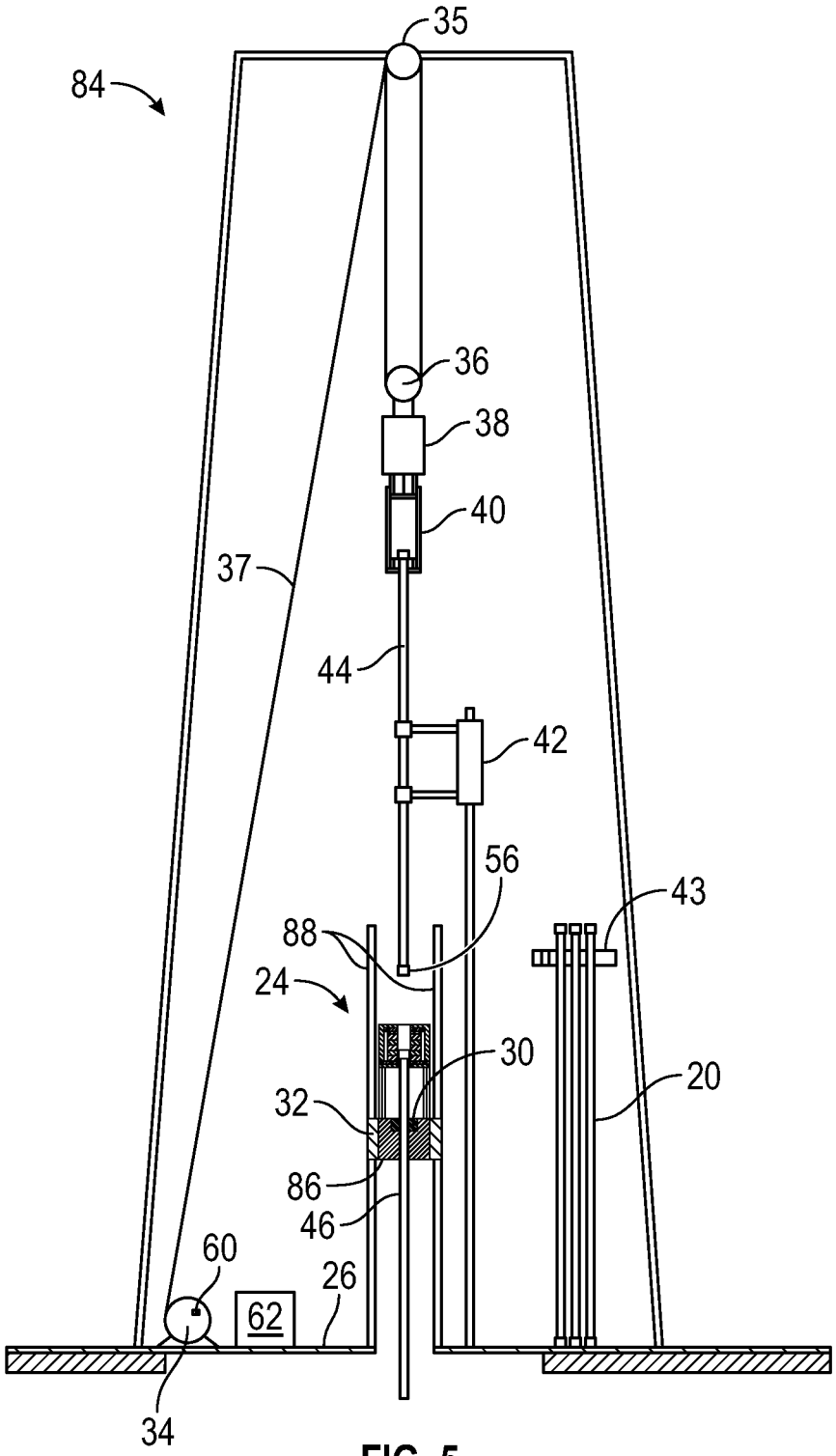
FIG. 5 illustrates a block diagram of a computing system of FIG. 2, in accordance with an embodiment.

The computing system 62 may operate in conjunction with additional embodiments of drilling rigs. For example, FIG. 5 illustrates another embodiment of a drilling rig 84 that may be utilized in an operation, such as a tripping operation consistent with embodiments of the present disclosure and that may operate in conjunction with the computing system 62 of FIG. 5. As illustrated in FIG. 5, the tripping apparatus 24 is positioned above drill floor 26 in the drilling rig 84. However, as will be discussed in greater detail below, the tripping apparatus 24 may be moved towards and away from the drill floor 26 during a tripping operation. As illustrated, the drilling rig 84 may include one or more of, for example, the tripping apparatus 24, a movable platform 86 (that may include floor slips 30 positioned in rotary table 32, as illustrated in FIG. 5), drawworks 34, a crown block 35, a travelling block 36, a top drive 38, an elevator 40, and a tubular handling apparatus 42. The tripping apparatus 24 may operate to couple and decouple tubular segments (e.g., couple and decouple drill pipe 20 to and from a drill string) while the floor slips 30 may operate to close upon and hold a drill pipe 20 and/or the drill string passing into the wellbore. The rotary table 32 may be a rotatable portion that can be locked into positon co-planar with the drill floor 26 and/or above the drill floor 26. The rotary table 32 can, for example, operate to impart rotation to the drill string either as a primary or a backup rotation system (e.g., a backup to the top drive 38) as well as utilize its floor slips 30 to support tubular segments, for example, during a tripping operation or may be a false rotary table that does not impart rotation to the drill string while still allowing for support of tubular segments utilizing its floor slips 30.

The drawworks 34 may be a large spool that is powered to retract and extend line 37 (e.g., wire cable or drill line) over a crown block 35 (e.g., a vertically stationary set of one or more pulleys or sheaves through which the line 37 is threaded) and a travelling block (e.g., a vertically movable set of one or more pulleys or sheaves through which the line 37 is threaded) to operate as a block and tackle system for movement of the top drive 38, the elevator 40, and any tubular segment (e.g., drill pipe 20) coupled thereto. In some embodiments, the top drive 38 and/or the elevator 40 may be referred to as a tubular support system or the tubular support system may also additionally include the block and tackle system described above.

The top drive 38 may be a device that provides torque to (e.g., rotates) the drill string as an alternative to the rotary table 32 and the elevator 40 may be a mechanism that may be closed around a drill pipe 20 or other tubular segments (or similar components) to grip and hold the drill pipe 20 or other tubular segments while those segments are moving vertically (e.g., while being lowered into or raised from a wellbore) or directionally (e.g., during slant drilling). The tubular handling apparatus 42 may operate to retrieve a tubular segment from a storage location 43 (e.g., a pipe stand) and position the tubular segment during tripping-in to assist in adding a tubular segment to a tubular string. Likewise, the tubular handling apparatus 42 may operate to retrieve a tubular segment from a tubular string and transfer the tubular segment to a storage location (e.g., a pipe stand) during tripping-out to remove the tubular segment from the tubular string.

During a tripping-in operation, the tubular handling apparatus 42 may position a tubular segment 44 (e.g., a drill pipe 20) so that the segment 44 may be grasped by the elevator 40. Elevator 40 may be lowered, for example, via the block and tackle system towards the tripping apparatus 24 to be coupled to tubular segment 46 (e.g., a drill pipe 20) as part of a drill string. In some embodiments, the tripping apparatus 24 may operate as discussed in conjunction with FIG. 3 above during a tripping operation. However, while tripping operations involving singular tubular segments 44 and 46 (e.g., drill pipe 20) has been discussed with respect to FIGS. 2-5, it is envisioned that a stand of tubular segments 44, 46 (e.g., two, three, or more tubular segments 44, 46 coupled together) may be the tubular segments being tripped-in or tripped-out. Additionally, continuous tripping operations (tripping tubular segments without halting the movement of the tubular string at a fixed position) may be facilitated and/or accelerated through the inclusion of the movable platform 86.

The movable platform 86 may be raised and lowered with a cable and sheave arrangement (e.g., similar to the block and tackle system for movement of the top drive 38) that may include a winch or other drawworks element positioned on the drill floor 26 or elsewhere on the offshore platform 10 or the drilling rig 22. The winch or other drawworks element may be a spool that is powered to retract and extend a line (e.g., a wire cable) over a crown block (e.g., a stationary set of one or more pulleys or sheaves through which the line 37 is threaded) and a travelling block (e.g., a movable set of one or more pulleys or sheaves through which the line 37 is threaded) to operate as a block and tackle system for movement of the movable platform 86 and, thus, the rotary table 32 therein and the tripping apparatus 24 thereon. Additionally and/or alternatively, one or more direct acting cylinders, a suspended winch and cable system, or other internal or external actuation systems may be used to move the movable platform 86 along one or more supports 88.

In some embodiments, the one or more supports 88 may be one or more guide mechanisms (e.g., guide tracks, such as top drive dolly tracks) that provide support (e.g., lateral support) to the movable platform 86 while allowing for movement towards and away from the drill floor 26. One or more lateral supports of the movable platform 86 may be used to couple the movable platform 86 to the one or more supports 88. For example, one more lateral supports of the movable platform 86 may be, for example, pads that may be made of Teflon-graphite material or another low-friction material (e.g., a composite material) that allows for motion of the movable platform 86 relative to drill floor 26 and/or the tubular segment support system with reduced friction characteristics. In addition to, or in place of the aforementioned pads, other lateral supports of the movable platform 86 including bearing or roller type supports (e.g., steel or other metallic or composite rollers and/or roller bearings) may be utilized. The lateral supports of the movable platform 86 may allow the movable platform 86 to interface with a guide (e.g., guide tracks, such as top drive dolly tracks) so that the movable platform 86 is movably coupled to the one or more supports 88. Accordingly, the movable platform 86 may be movably coupled to one or more supports 88 to allow for movement of the movable platform 86 (e.g., towards and away from the drill floor 26 and/or the tubular segment support system while maintaining contact with the guide tracks or other guides) during a tripping operation (e.g., a continuous tripping operation).

Figure 6:
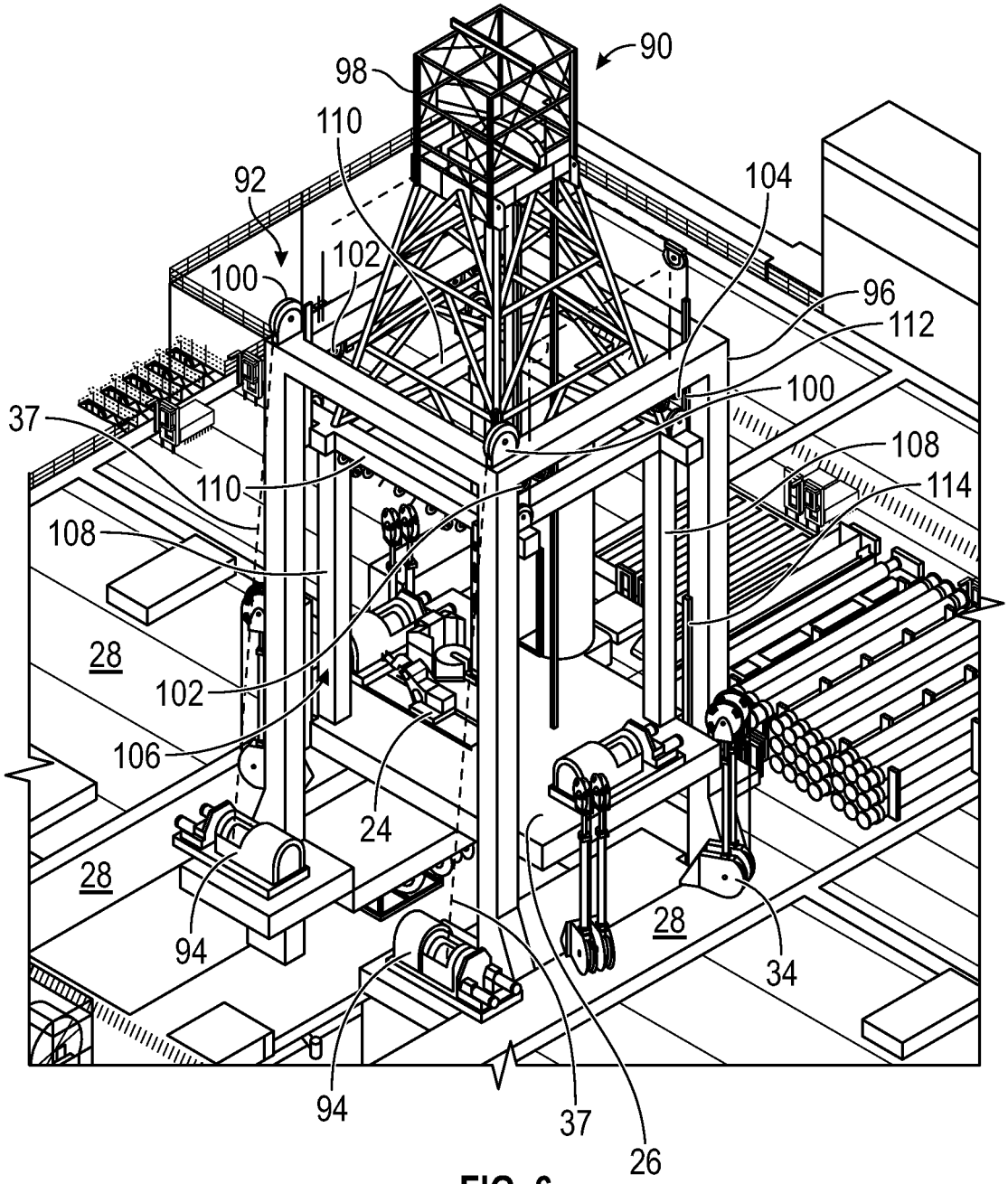
FIG. 6 illustrates an isometric view of a third embodiment of a drilling rig as illustratively presented in FIG. 1, in accordance with an embodiment.

FIG. 6 illustrates an embodiment in which a drilling rig 90 similar to those described above can be utilized. For example, the drilling rig 90 may be substantially similar to the drilling rig 22 or the drilling rig 84 as described above. However, the drilling rig 90 may include an active heave compensation system 92, as described herein. The active heave compensation system 92 includes, for example, one or more active heave drawworks 94 and a fixed frame 96, which circumscribes at least one of the drill floor 26 and a derrick 98. In some embodiments, the one or more active heave drawworks 94 can be defined as an actuation system and/or the actuation system can employ other lifting components in place of or in addition to the one or more active heave drawworks 94. The one or more active heave drawworks 94 may be a large spool that is powered to retract and extend a line 37 (e.g., wire cable or drill line) over a set of one or more pulleys or sheaves through which the line 37 is threaded. The set of one or more pulleys or sheaves may be a cable and sheave arrangement similar to the block and tackle system described above and the line 37 may be a single cable routed in the manner described below from a first active heave drawworks 94 to a second active heave drawworks 94 via the cable and sheave arrangement. Likewise, the line 37 may be a single cable routed in the manner described below via the cable and sheave arrangement from a first active heave drawworks 94 to a connector (e.g., an anchor blot, eye bolt, screw eye, padeye, or another connector) coupled to, on, or in deck 28, which operates as an anchor point. In other embodiments, the active heave and compensation system 92 can include an actuation system that includes elements that operate in parallel, for example, a first line 37 as a single cable routed in the manner described below from a first active heave drawworks 94 to a second active heave drawworks 94 via the cable and sheave arrangement and a second line 37 as a second single cable routed in the manner described below from a third active heave drawworks 94 to a fourth active heave drawworks 94 via the cable and sheave arrangement (or a second cable and sheave arrangement). Likewise, a line 37 may be a single cable routed in the manner described below via the cable and sheave arrangement from a first active heave drawworks 94 to a connector (e.g., an anchor blot, eye bolt, screw eye, padeye, or another connector) coupled to, on, or in deck 28, which operates as an anchor point and a second line 37 may be a second single cable routed in the manner described below via the cable and sheave arrangement (or a second cable and sheave arrangement) from a second active heave drawworks 94 to a second connector (or the first connector) coupled to, on, or in deck 28, which operates as an anchor point. In this manner, parallel operations can be undertaken using the actuation system. Additionally, the active heave compensation system 92 may include the cable and sheave arrangement (e.g., the set of one or more pulleys or sheaves).

In some embodiments, the cable and sheave arrangement (e.g., the set of one or more pulleys or sheaves) coupled to the one or more active heave drawworks 94 may include, for example, one or more upper sheaves 100 disposed on an upper or topmost portion of the fixed frame 96. In one embodiment, a first upper sheave 100 is disposed on a topmost beam of the fixed frame 96 at a first corner of an upper portion of the fixed frame 96 and a second upper sheave 100 is disposed on the topmost beam of the fixed frame 96 at a second corner of an upper portion of the fixed frame 96. In some embodiments, there is an upper sheave 100 that corresponds to each active heave drawworks 94. Each of the one or more upper sheaves 100 may be disposed at a respective corner of the upper or topmost portion of the fixed frame 96 (e.g., a first upper sheave 100 disposed at a first upper corner of the fixed frame 96 and a second upper sheave 100 disposed at a second upper corner of the fixed frame 96), whereby the first and the second upper corners of the fixed frame 96 on which the upper sheaves 100 are disposed are adjacent to the active heave drawworks 94 (or physical connection or anchor point). The one or more upper sheaves 100 may receive the line 37 directly from its respective active heave drawworks 94 (or from a physical connection or anchor point).

Additionally, the cable and sheave arrangement (e.g., the set of one or more pulleys or sheaves) may further include one or more lower sheaves 102 and one or more lower sheaves 104. The one or more lower sheaves 102 may be coupled to an underside of the upper or topmost portion of the fixed frame 96. In this manner, the one or more lower sheaves 102 may be disposed generally below (towards the deck 28) the one or more upper sheaves 100. For example, the one or more lower sheaves 102 can be disposed under (on a bottom side towards the deck 28) a beam or other support on which the one or more upper sheaves 100 is disposed. In some embodiments, one or more than one (e.g., two, three, or more) sheaves as the one or more lower sheaves 102 may be disposed below each of the one or more upper sheaves 100. For example, one or more lower sheaves 102 may be disposed at a respective corner of the upper or topmost portion of the fixed frame 96 (e.g., a first one or more lower sheaves 102 can be disposed at a first upper corner of the fixed frame 96 under a beam or other support on which a first upper sheave 100 is disposed, i.e., below the first upper sheave 100, and a second one or more lower sheaves 102 can be disposed at a second upper corner of the fixed frame 96 under a beam or other support on which a second upper sheave 100 is disposed, i.e., below the second upper sheave 100), whereby the first and the second upper corners of the fixed frame 96 on which the lower sheaves 102 are disposed are adjacent to the active heave drawworks 94 (or physical connection or anchor point).

Similarly, the one or more lower sheaves 104 may be coupled to the underside of the upper or topmost portion of the fixed frame 96. In some embodiments, one or more than one (e.g., two, three, or more) sheaves as the one or more lower sheaves 104 may be disposed along the underside of the upper or topmost portion of the fixed frame 96. The one or more lower sheaves 104 may also be disposed generally below (towards the deck 28) the one or more upper sheaves 100. For example, the one or more lower sheaves 104 can be disposed under (on a bottom side towards the deck 28) a beam or other support on which the one or more upper sheaves 100 is disposed. However, the one or more lower sheaves 104 may also be separated from the one or more upper sheaves 100 by the length of the fixed frame 96.

For example, one or more lower sheaves 104 may be disposed at a respective corner of the upper or topmost portion of the fixed frame 96 (e.g., a first one or more lower sheaves 104 can be disposed at a third upper corner of the fixed frame 96 under a beam or other support on which a first upper sheave 100 is disposed, i.e., below the first upper sheave 100 and at a distance of the length of the fixed frame 96 from the first upper sheave 100). Likewise, for example, a second one or more lower sheaves 104 can be disposed at a separate respective corner of the of the upper or topmost portion of the fixed frame 96 (e.g., a second one or more lower sheaves 104 can be disposed at a fourth upper corner of the fixed frame 96 under a beam or other support on which a first upper sheave 100 is disposed, i.e., below a second upper sheave 100 and at a distance of the length of the fixed frame 96 from the second upper sheave 100). Thus, a first one or more lower sheaves 102 and a first one or more of the lower sheaves 104 may be disposed on or coupled to the underside of the upper or topmost portion of the fixed frame 96 at a distance of the length of the fixed frame 96 so that each of the first one or more lower sheaves 102 and the first one or more of the lower sheaves 104 are disposed in respective upper corners of the fixed frame 96. Likewise, a second one or more lower sheaves 102 and a second one or more of the lower sheaves 104 may be disposed on or coupled to the underside of the upper or topmost portion of the fixed frame 96 at a distance of the length of the fixed frame 96 so that each of the first one or more lower sheaves 102 and the first one or more of the lower sheaves 104 are disposed in respective upper corners of the fixed frame 96. Thus, in one embodiment, each upper corner of the fixed frame 96 may have a set of one or more lower sheaves 102 or one or more lower sheaves 104 disposed thereat.

The active heave compensation system 92 further includes, for example, a heave compensation frame 106. The heave compensation frame 106 may be a structure that includes the drill floor 26 as a bottom portion, one or more structural beams 108 disposed, for example, along edges and/or at corners of the drill floor 26 and extending vertically (e.g., perpendicular to) away from the drill floor 26, and one or more upper beams 110 that extend horizontally (e.g., perpendicular to the one or more structural beams 108) and are coupled to the structural beams 108. The heave compression frame 106 can be coupled a tubular string extending to the seafloor 14 and/or into a wellbore below the seafloor 14. For example, a drill string made up of drill pipes 20 may be held by the floor slips 30 of the drill floor 26, whereby the drill string extends to the seafloor 14 and/or into a wellbore below the seafloor 14. In some embodiments, the derrick 98 is disposed on the one or more upper beams 110. The heave compensation frame 106 is sized to fit within the fixed frame 96. The heave compensation frame 106 may be slidingly coupled to the fixed frame 96 such that the heave compensation frame 106 can move towards and away from the deck 28 while the fixed frame 96 remains stationary with respect to the deck 28. The fixed frame 96 may also restrict lateral movement (e.g., movement in a horizontal direction along the deck 28) of the heave compensation frame 106. In this manner, the heave compensation frame 106 is slidingly coupled to the fixed frame 96 (e.g., the heave compensation frame 106 is able to move in one plane with respect to the fixed frame 96 while being restricted from movement in a second plane with respect to the fixed frame).

In some embodiments, one or more guides (e.g., tracks or the like) may be used to couple the heave compensation frame 106 to the fixed frame 96. For example, an upper guide 112 may be disposed along each vertical support column of the fixed frame 96 and a lower guide 114 may be disposed along each vertical support column of the fixed frame 96 at a location below (e.g., towards the deck 28) the upper guide 112. In some embodiments, there may be one or more guides (e.g., an upper guide 112 and a lower guide 114) that correspond to each structural beam 108 of the heave compensation frame 106. In some embodiments, one or more lateral supports may be coupled to one or more of the drill floor 26, the one or more structural beams 108, and/or the one or more upper beams 110 to couple the heave compensation frame 106 to the fixed frame. In some embodiments, the one or more guides and the one or more lateral supports can be male and female connectors or other types of connectors. For example, the one or more lateral supports may be, for example, pads that may be made of Teflon-graphite material or another low-friction material (e.g., a composite material) that allows for motion of the heave compensation frame 106 relative to drill floor 26 with reduced friction characteristics. In addition to, or in place of the aforementioned pads, other lateral supports including bearing or roller type supports (e.g., steel or other metallic or composite rollers and/or roller bearings) may be utilized to allow for horizontal load transfer between the heave compensation frame 106 and the fixed frame 96 with minimal resistance to vertical motion. The one or more lateral supports may allow the heave compensation frame 106 to interface with a the one or more guides so that the heave compensation frame 106 is movably coupled to the fixed frame 96. In this manner, the heave compensation frame 106 may be movably coupled to the fixed frame 96 to allow for movement of the heave compensation frame 106 (e.g., towards and away from the drill floor 26 while maintaining contact with the guide tracks or other support element of the fixed frame).

In some embodiments, the heave compensation frame 106 may be raised and lowered with the cable and sheave arrangement via one or more of the active heave drawworks 94. One technique for connecting the cable and sheave arrangement is described below; however it should be appreciated that alternate configurations are contemplated. In one embodiment, the line 37 may be routed directly from a first active heave drawworks 94 of the one or more active heave drawworks 94 to a first one of the one or more upper sheaves 100 and passed to a connector (e.g., an anchor blot, eye bolt, screw eye, padeye, a pulley, or another connector) coupled to the heave compensation frame 106 (e.g., coupled to one of the one or more upper beams 110 at a first upper beam location) or passed to a sheave coupled to a connector coupled to the heave compensation frame 106. The line 37 may then be routed to a first one of the one or more lower sheaves 102 at a first location (e.g., a first upper corner) of the fixed frame 96 and passed back to the connector (or the sheave coupled to the connector) of the heave compensation frame 106 if another of the one or more lower sheaves 102 is present at the first location. The line 37 can then be routed to a second one of the one or more lower sheaves 102 at the first location (e.g., the first upper corner) of the fixed frame 96 when a second one of the one or more lower sheaves 102 is present at the first location (e.g., the first upper corner) of the fixed frame 96. The line 37 may be routed from the second one of the one or more lower sheaves 102 to a first one of the one or more lower sheaves 104 at a second location (e.g., a second upper corner) of the fixed frame 96 when the second one of the one or more lower sheaves 102 is present at the first location (e.g., the first upper corner) of the fixed frame 96. Alternatively, the line 37 may be routed from the first one of the one or more lower sheaves 102 to the first one of the one or more lower sheaves 104 at the second location (e.g., the second upper corner) of the fixed frame 96 when the second one of the one or more lower sheaves 102 is not present at the first location (e.g., the first upper corner) of the fixed frame 96.

The line 37 may be routed from the first one of the one or more lower sheaves 104 at the second location (e.g., a second upper corner) of the fixed frame 96 to a second connector (e.g., an anchor blot, eye bolt, screw eye, padeye, a pulley, or another connector) coupled to the heave compensation frame 106 (e.g., coupled to one of the one or more upper beams 110 at a second upper beam location) or passed to a sheave coupled to the second connector. The line 37 may then be routed from the second connector (or sheave coupled to the second connector) to a second one of the one or more lower sheaves 104 at the second location (e.g., the second upper corner) of the fixed frame 96 if another of the one or more lower sheaves 104 is present at the second location (e.g., the second upper corner) of the fixed frame 96. The line 37 may be routed from the second one of the one or more lower sheaves 104 to a first one of the one or more lower sheaves 104 at a third location (e.g., a third upper corner) of the fixed frame 96 when the second one of the one or more lower sheaves 104 is present at the second location (e.g., the second upper corner) of the fixed frame 96. Alternatively, the line 37 may be routed from the second connector back to the first one of the one or more lower sheaves 104 at the second location (e.g., the second upper corner) and then to a first one of the one or more lower sheaves 104 at the third location (e.g., the third upper corner) of the fixed frame 96 when the second one of the one or more lower sheaves 104 is not present at the second location (e.g., the second upper corner) of the fixed frame 96.

The line 37 may be routed from the first one of the one or more lower sheaves 104 at the third location (e.g., the third upper corner) of the fixed frame 96 to a third connector (e.g., an anchor blot, eye bolt, screw eye, padeye, a pulley, or another connector) coupled to the heave compensation frame 106 (e.g., coupled to one of the one or more upper beams 110 at a third upper beam location) or passed to a sheave coupled to the third connector. The line 37 may then be routed from the third connector (or sheave coupled to the third connector) to a second one of the one or more lower sheaves 104 at the third location (e.g., the third upper corner) of the fixed frame 96 if another of the one or more lower sheaves 104 is present at the third location (e.g., the third upper corner) of the fixed frame 96. The line 37 may be routed from the second one of the one or more lower sheaves 104 to a first one of the one or more lower sheaves 102 at a fourth location (e.g., a fourth upper corner) of the fixed frame 96 when the second one of the one or more lower sheaves 104 is present at the third location (e.g., the third upper corner) of the fixed frame 96. Alternatively, the line 37 may be routed from the third connector back to the first one of the one or more lower sheaves 104 at the third location (e.g., the third upper corner) and then to a first one of the one or more lower sheaves 102 at a fourth location (e.g., a fourth upper corner) of the fixed frame 96 when the second one of the one or more lower sheaves 104 is not present at the third location (e.g., the third upper corner) of the fixed frame 96.

The line 37 may be routed from the first one of the one or more lower sheaves 102 at the fourth location (e.g., the fourth upper corner) of the fixed frame 96 to a fourth connector (e.g., an anchor blot, eye bolt, screw eye, padeye, a pulley, or another connector) coupled to the heave compensation frame 106 (e.g., coupled to one of the one or more upper beams 110 at a fourth upper beam location) or passed to a sheave coupled to the fourth connector. The line 37 may then be routed from the fourth connector (or sheave coupled to the fourth connector) to a second one of the one or more lower sheaves 102 at the fourth location (e.g., the fourth upper corner) of the fixed frame 96 if another of the one or more lower sheaves 102 is present at the fourth location (e.g., the fourth upper corner) of the fixed frame 96. The line 37 may be routed from the second one of the one or more lower sheaves 102 to the fourth connector (or sheave coupled to the fourth connector) and thereafter to a second one of the one or more upper sheaves 100 disposed at a second location on the fixed frame 96 at a distance approximately equal to the width of the fixed frame from the location of the first one of the one or more upper sheaves 100. Alternatively, the line 37 may be routed from the second one of the one or more lower sheaves 102 to the second of the one or more upper sheaves 100 disposed at the second location on the fixed frame 96. Furthermore, when no second one of the one or more lower sheaves 102 is present the at the fourth location (e.g., the fourth upper corner) of the fixed frame 96, the line 37 can be routed to the second of the one or more upper sheaves 100 disposed at the second location on the fixed frame 96 subsequent to being routed to the fourth connector by the first one of the one or more lower sheaves 102 at the fourth location (e.g., the fourth upper corner) of the fixed frame 96. The line 37 can then be routed to the second active heave drawworks 94 of the one or more active heave drawworks 94 (if present) or to a connector (e.g., an anchor blot, eye bolt, screw eye, padeye, or another connector) coupled to, on, or in deck 28, which operates as an anchor point (if the second active heave drawworks 94 of the one or more active heave drawworks 94 is not present or is not being utilized).

Figure 7:
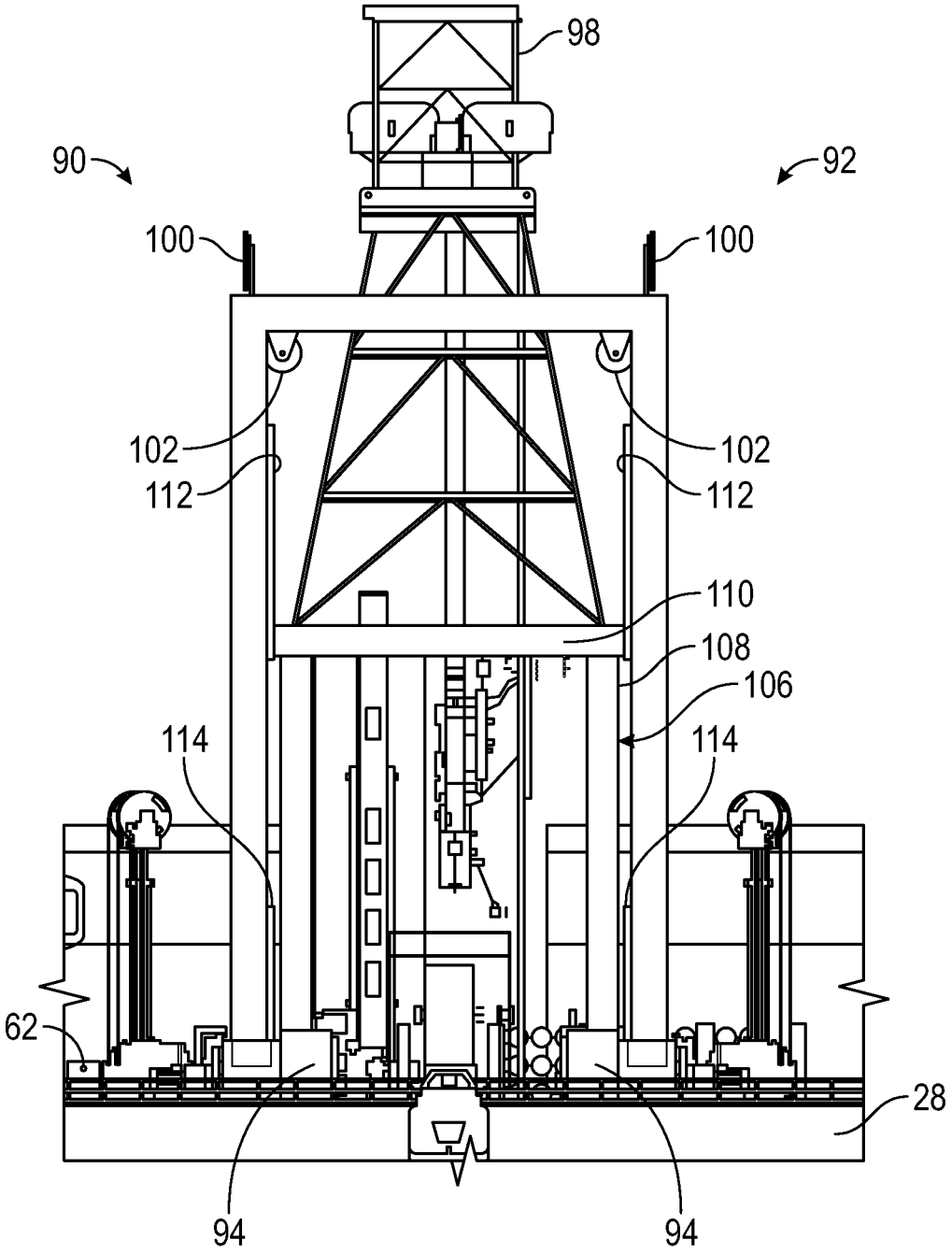
FIG. 7 illustrates an side view of the third embodiment of a drilling rig of FIG. 6, in accordance with an embodiment.

FIG. 7 illustrates a side view of the drilling rig 90 described inclusive of the active heave compensation system 92. As illustrated, the second active heave drawworks 94 of the one or more active heave drawworks 94 may operate as an anchor (e.g., locking the line 37 to restrict its movement) while the first active heave drawworks 94 of the one or more active heave drawworks 94 extends and retracts the line 37 to compensate for heave, as will be described in more detail below with respect to FIG. 8. Additionally and/or alternatively, the second active heave drawworks 94 of the one or more active heave drawworks 94 may operate in conjunction with the first active heave drawworks 94 of the one or more active heave drawworks 94 to extend and retract the line 37 to compensate for heave, for example, to increase the speed at which the line 37 can be extended and retracted. Furthermore, the second active heave drawworks 94 of the one or more active heave drawworks 94 may be removed and a connector (e.g., an anchor blot, eye bolt, screw eye, padeye, or another connector) coupled to, on, or in deck 28 may be added to operate as an anchor point for the line 37. Likewise, additionally and/or alternatively, one or more direct acting cylinders or other internal or external actuation device may be used to move the heave compensation frame 106 along the one or more guides (e.g., the upper guide 112 and the lower guide 114) in place of or in addition to the one or more active heave drawworks 94 as the actuation system.

FIG. 7 further illustrates the computing system 62 previously described above. In some embodiments, the computing system 62 may operate to configure (i.e., set-up) control of one or more of the active heave drawworks 94, for example, to initialize a motor control of the active heave drawworks 94. Alternatively, the computing system 62 runs a program stored therein to control operation of the one or more active heave drawworks 94. The operation of the active heave compensation system 92 is discussed below with respect to FIGS. 8 and 9.

Figure 8:
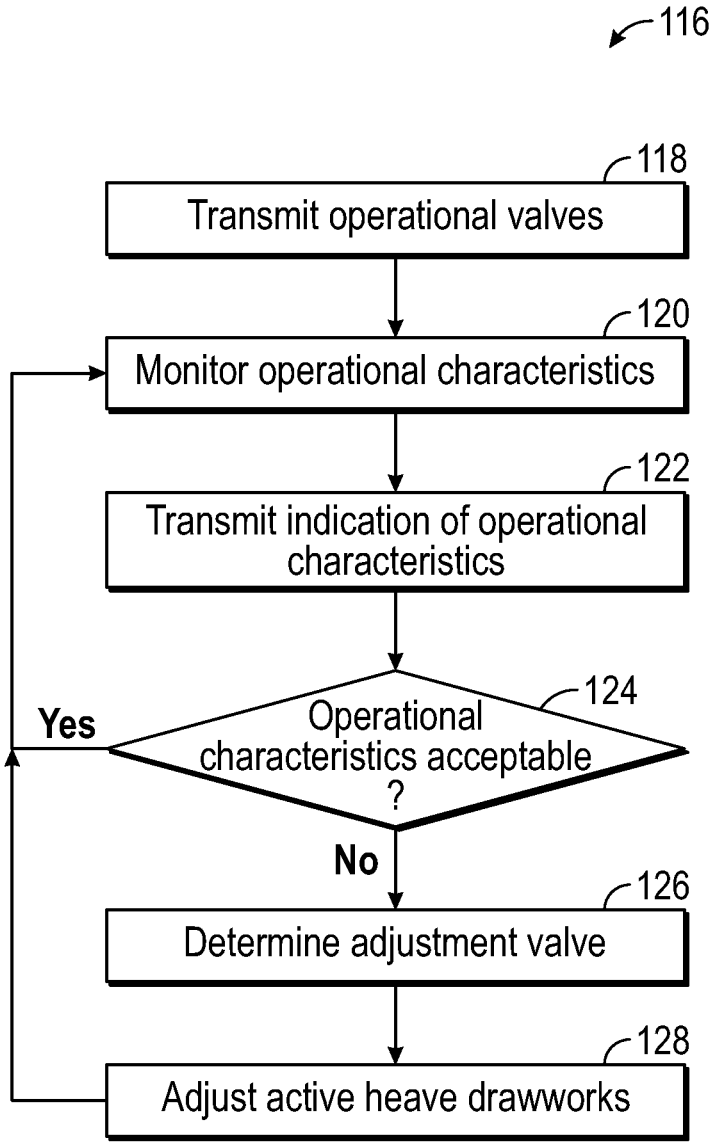
FIG. 8 illustrates a flow diagram of the actuation system of the drilling rig of FIGS. 6 and 7, in accordance with an embodiment.

FIG. 8 illustrates a flow chart 116 details the operation of an actuation system, for example, including the one or more active heave drawworks 94, in accordance with an embodiment. In step 118, operational values, such as one or more tension values and/or load values that correspond to allowable tensions and/or loads on the line 37 are transmitted to the one or more active heave drawworks 94. These operational values may correspond to, for example, a predetermined value for the allowable tensions and/or loads on the line 37. Additionally or alternatively, the operational values may correspond to predetermined ranges of values about a predetermined value for allowable tensions and/or loads on the line 37. The operational values may be initially provided to, for example, a motor control or other controller of the one or more active heave drawworks 94, for example, by the computing system 62 or via an input on the active heave drawworks 94.

In step 120, operational characteristics of one or more components of the one or more active heave drawworks 94 are monitored. For example, one or more sensors in the one or more active heave drawworks 94 may determine tension on the line 37 and/or may monitor load on the line 37. The sensed operational characteristics may change during operation of the one or more active heave drawworks 94. For example, the offshore platform 10 can move vertically away from the seafloor 14 due to waves, winds, or other factors. This causes the deck 28 on which the one or more active heave drawworks 94 is disposed to move vertically away from the seafloor 14, thus resulting in an increase in tension and/or load on the line 37, which is monitored as an operational characteristic in step 120. Likewise, the offshore platform 10 can move vertically towards the seafloor 14 due to conditions or factors, causing the deck 28 on which the one or more active heave drawworks 94 is disposed to move vertically towards the seafloor 14, resulting in a decrease in tension and/or load on the line 37, which is monitored as an operational characteristic in step 120. In step 122, the operational characteristics that are monitored in step 120 are transmitted in step 122. This transmission may be from the one or more sensors in the one or more active heave drawworks 94 or from a transmitter that receives the operational characteristics from the one or more sensors.

The indication (e.g., via transmitted signal) of the operational characteristics are received by a controller of the active heave drawworks 94 or, in other embodiments, by the processing device 64 of the computing system 62. The controller of the active heave drawworks 94 or the processing device 64 of the computing system 62 determines, in step 124, whether the indication of the sensed value (e.g., the operational characteristics) represents an increase, a fall, or no change in the tension and/or load on the line 37. If the indication is, for example, determined to be the same as a predetermined value, approximately the same as a predetermined value (e.g., within a predetermined tolerance of the predetermined value), or is within a predetermined range of a predetermined value (e.g., within a percentage of the predetermined value), the operational characteristics are deemed acceptable in step 124 and the process returns to step 120. It should be noted that indications may be transmitted in step 122 and determinations in step 124 may be made continuously (i.e., as a stream of uninterrupted data inputs and decisions), near continuously (i.e., as a stream of data inputs and decisions slowed only by factors such as data sensing time, transmission time, calculation time, and other operational limiting characteristics), or on a schedule (e.g., at approximately every five minutes, approximately every two minutes, approximately every minute, approximately two times a minute, approximately ten times a minute, approximately twenty times a minute, approximately thirty times a minute, approximately sixty times a minute, approximately a predetermined fraction of a second, or another time period).

Returning to step 124, if the controller of the active heave drawworks 94 or the processing device 64 of the computing system 62 determines, in step 124, that, for example, the indication is not the same as a predetermined value, not approximately the same as a predetermined value (e.g., not within a predetermined tolerance of the predetermined value), or is not within a predetermined range of a predetermined value (e.g., not within a percentage of the predetermined value), the operational characteristics are deemed unacceptable in step 124 and the process moves to step 126.

In step 126, the controller of the active heave drawworks 94 or the processing device 64 of the computing system 62 determines an amount of adjustment by the one or more active heave drawworks 94 to return the tension and/or load of the line 37 to the predetermined value. This amount of adjustment can be, for example, the amount of rotation of a drum of the one or more active heave drawworks 94 to extend or retract the line 37 as necessary so as to keep the tension and/or the load on the line 37 at a predetermined value or within a predetermined range of values about a predetermined value. The amount of adjustment is transmitted as a control signal to, for example, a motor control of the active heave drawworks 94 by the controller of the active heave drawworks 94 or the computing system 62.

In step 128, a motor controller, for example, of the one or more active heave drawworks 94 rotates the drum of the one or more active heave drawworks 94 based on the control signal received from the controller of the active heave drawworks 94 or the computing system 62. The control signal causes the amount and direction of the rotation to be imparted to the drum by the motor controller. This has the effect of keeping the tension and/or load on the line 37 relatively constant (i.e., at a predetermined value or within a predetermined range about a predetermined value) and causes the heave compensation frame 106 (as well as the derrick 98 and inclusive of the drill floor 26) to move along the one or more guides (e.g., the upper guide 112 and the lower guide 114) towards the deck 28 as the deck 28 is moving vertically away from the seafloor 14 when the line 37 is extended from the one or more active heave drawworks 94 by rotation of the drum therein. Similarly, the control signal can cause the heave compensation frame 106 (as well as the derrick 98 and inclusive of the drill floor 26) to move along the one or more guides (e.g., the upper guide 112 and the lower guide 114) away from the deck 28 as the deck 28 is moving vertically towards from the seafloor 14 when the line 37 is retracted to the one or more active heave drawworks 94 by rotation of the drum therein. These respective operations that are undertaken, for example, as a result of vertical movement of the offshore platform 10 with respect to the seafloor 14 keeps the heave compensation frame 106 (as well as the derrick 98 and inclusive of the drill floor 26) at a constant or nearly constant distance from the seafloor 14.

The operation of the active heave compensation system 92 allows for movement of the drill floor 26 by, for example, approximately 25 feet (e.g., plus or minus 12.5 feet relative to the hull of the offshore platform 10) to compensate for vertical movements of the offshore platform 10 with respect to the seafloor 14. The use of two active heave drawworks 94 can provide redundancy (for example, if only one active heave drawworks 94 is used in operation to adjust the line 37 tension with the other operating as an anchor point) as well to as implement more rapid adjustments (for example, if two one active heave drawworks 94 are used in conjunction to adjust the line 37 tension). Additionally, use of the active heave compensation system 92 can eliminate the use of a coil tubing lifting frame as well as passive heave compensation systems for a drill string, such as, a crown or top mounted compensator. Furthermore, by utilizing the fixed frame 96 and the heave compensation frame 106 as described herein, effects on stability and wind loading can be minimized.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A system, comprising:

a first structure configured to be coupled to a tubular string extending to a seafloor, wherein the first structure comprises a drill floor, wherein the first structure circumscribes a derrick of an offshore vessel; and a second structure circumscribing the first structure and slidingly coupled to the first structure via at least one guide to provide a lateral force to the first structure while allowing for vertical movement between the first structure as well as the derrick and the second structure relative to the seafloor, wherein the second structure comprises at least one vertically disposed beam configured to be directly coupled to a deck of an offshore vessel, wherein the at least one vertically disposed beam is directly coupled to the at least one guide.

2. The system of claim 1, comprising an actuation system disposed adjacent to the second structure.

3. The system of claim 2, comprising an active heave drawworks as at least a portion of the actuation system.

4. The system of claim 3, comprising a line coupled to the active heave drawworks and connected to the first structure.

5. The system of claim 4, wherein the active heave drawworks comprises:

a drum as a portion of the active heave drawworks coupled to the line; and a controller that when in operation controls rotation of the drum to retract the line around the drum when the second structure moves vertically towards the seafloor.

6. The system of claim 5, wherein the controller when in operation controls rotation of the drum to extend the line from the drum when the second structure moves vertically away from the seafloor.

7. The system of claim 4, comprising an upper sheave disposed on the second structure, wherein the line passes along the upper sheave to the first structure.

8. The system of claim 7, comprising a lower sheave disposed on the second structure, wherein the line passes from the first structure to along the lower sheave.

9. The system of claim 8, wherein the line is coupled to an anchor point subsequent to passing along the lower sheave.

10. The system of claim 8, wherein the line is coupled to a second active heave drawworks as a second portion of the actuation system subsequent to passing along the lower sheave.

11. The system of claim 10, wherein the second active heave drawworks comprises:

a second drum as a portion of the second active heave drawworks coupled to the line; and a second controller that when in operation:

controls rotation of the second drum to retract the line around the second drum when a first control signal is received; and controls rotation of the second drum to extend the line from the second drum when a second control signal is received.

12. The system of claim 11, wherein the second controller when in operation locks the second drum to generate an anchor point upon receipt of a third control signal.

13. A system, comprising:

a first structure, comprising:

a drill floor;

one or more beams coupled to and disposed about the drill floor; and one or more upper beams directly coupled to the one or more beams;

a derrick directly coupled to the one or more upper beams; and a second structure disposed at least partially around the first structure, wherein the second structure contacts the first structure to provide a lateral force to the first structure while allowing for vertical movement between the first structure as well as the derrick and the second structure while maintaining a predetermined distance between the first structure and a seafloor.

14. The system of claim 13, wherein the second structure comprises one or more guides to interface with at least a portion of the first structure.

15. The system of claim 14, comprising a lateral support as the at least a portion of the first structure.

16. The system of claim 15, wherein the lateral support comprises a roller bearings or pads.

17. The system of claim 13, comprising an actuation system coupled to the first structure, wherein when in operation, the actuation system controls the vertical movement between the first structure and the second structure to maintaining the predetermined distance between the first structure and the seafloor.

18. A tangible, non-transitory computer-readable medium having computer executable code stored thereon, the computer executable code comprising instructions to cause a processor to:

receive data related to operational characteristics of a drawworks of an actuation system, wherein the operational characteristics indicate tension or load on a line coupled to a first structure comprising a drill floor, one or more beams coupled to and disposed about the drill floor, and one or more upper beams directly coupled to the one or more beams, wherein the first structure moves vertically relative to a second structure laterally supporting the first structure, wherein the second structure comprises at least one vertically disposed beam configured to be directly coupled to a deck of an offshore vessel, wherein the at least one vertically disposed beam is coupled to the first structure via at least one guide;

determine if the operational characteristics are acceptable;

determine an adjustment value as a control signal when the operational characteristics are not determined to be acceptable; and transmit the control signal to control at least the portion of the actuation system to adjust the tension or load on the line to maintain a predetermined distance between the first structure and a seafloor while the first structure moves vertically relative to the second structure.

19. The tangible, non-transitory computer-readable medium of claim 18, wherein the computer executable code comprises instructions to determine if the operational characteristics are acceptable by comparing at least one of the operational characteristics to a predetermined value.

20. The tangible, non-transitory computer-readable medium of claim 18, wherein the computer executable code comprises instructions to determine if the operational characteristics are acceptable by comparing at least one of the operational characteristics to a predetermined range of values.

* * * * *